US008548348B2

(12) United States Patent
Sakata et al.

(10) Patent No.: US 8,548,348 B2
(45) Date of Patent: Oct. 1, 2013

(54) HIGH-VOLTAGE OUTPUT APPARATUS AND IMAGE FORMING APPARATUS

(75) Inventors: Shiro Sakata, Numazu (JP); Yusuke Saito, Susono (JP); Mitsunari Ito, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 202 days.

(21) Appl. No.: 13/038,546

(22) Filed: Mar. 2, 2011

(65) Prior Publication Data

US 2011/0217064 A1 Sep. 8, 2011

(30) Foreign Application Priority Data

Mar. 5, 2010 (JP) ..... 2010-048991

(51) Int. Cl.
*G03G 15/00* (2006.01)
*G03G 15/02* (2006.01)

(52) U.S. Cl.
USPC ..... 399/89; 399/48; 399/50

(58) Field of Classification Search
USPC ..... 399/89
See application file for complete search history.

(56) References Cited

U.S. PATENT DOCUMENTS

| | | | | |
|---|---|---|---|---|
| 4,456,825 | A * | 6/1984 | Kuge et al. | 250/324 |
| 5,132,869 | A * | 7/1992 | Nakaya | 361/233 |
| 5,499,080 | A | 3/1996 | Furuya et al. | |
| 5,805,956 | A * | 9/1998 | Kawai et al. | 399/46 |
| 6,640,063 | B2 * | 10/2003 | Adachi et al. | 399/50 |
| 6,985,680 | B2 | 1/2006 | Sakai et al. | |
| 7,630,659 | B2 | 12/2009 | Uchitani et al. | |
| 2003/0049038 | A1 * | 3/2003 | Buettner | 399/48 |
| 2004/0258430 | A1 * | 12/2004 | Ishii et al. | 399/89 |
| 2005/0111869 | A1 * | 5/2005 | Takami et al. | 399/89 |
| 2007/0212087 | A1 * | 9/2007 | Sakata | 399/50 |
| 2008/0145075 | A1 * | 6/2008 | Toda et al. | 399/50 |
| 2008/0152369 | A1 * | 6/2008 | DiRubio et al. | 399/48 |
| 2009/0028591 | A1 * | 1/2009 | Kubo | 399/50 |
| 2009/0041495 | A1 * | 2/2009 | Ishikawa | 399/66 |
| 2009/0052932 | A1 * | 2/2009 | Sakata | 399/88 |
| 2010/0092192 | A1 * | 4/2010 | Sakata | 399/50 |

FOREIGN PATENT DOCUMENTS

| | | | |
|---|---|---|---|
| CN | 1536450 | A | 10/2004 |
| CN | 1862407 | A | 11/2006 |
| JP | 06-003932 | A | 1/1994 |
| JP | 2000-305342 | A | 11/2000 |
| JP | 2009-180882 | A | 8/2009 |

OTHER PUBLICATIONS

Office Action dated May 30, 2013, in Chinese Patent Application No. 201110052020.X.

* cited by examiner

*Primary Examiner* — Walter L Lindsay, Jr.
*Assistant Examiner* — David Bolduc
(74) *Attorney, Agent, or Firm* — Fitzpatrick, Cella, Harper & Scinto

(57) ABSTRACT

The high-voltage output apparatus includes a voltage application part that applies a DC voltage to the charge member; a current detection part that detects a value of a current flowing in the image bearing member when the DC voltage is applied to the charge member; and a control part that calculates a plurality of discharge start voltages for the image bearing member, based on a plurality of current values detected by the current detection part as a result of the voltage application part applying a plurality of different DC voltages to the charge member, and controls the DC voltage applied to the charge member, using the plurality of calculated discharge start voltages. Consequently, a high-quality image can be formed by maintaining a potential on a photosensitive drum to be constant irrespective of the states of the circumstances and/or the drum layer thickness.

4 Claims, 13 Drawing Sheets

| FIG. 7A |
| --- |
| FIG. 7B |

| FIG. 9A |
| --- |
| FIG. 9B |

HIGH-VOLTAGE OUTPUT APPARATUS AND IMAGE FORMING APPARATUS

BACKGROUND OF THE INVENTION

1. Field of the Invention

The present invention relates to an apparatus that outputs a high voltage to a charge apparatus that charges an image bearing member, and an image forming apparatus including the same.

2. Description of the Related Art

Among known image forming apparatuses, a laser beam printer will be described as an example. A laser beam printer includes a mechanism such as illustrated in FIG. 11. As illustrated in FIG. 11, in a laser printer, a photosensitive drum 101, which is an image bearing member, a semiconductor laser 102, which is a light source, a rotary polygon mirror 103, which is rotated by a scanner motor 104, and a laser beam 105 emitted from the semiconductor laser 102, the laser beam 105 scanning the photosensitive drum 101, are arranged.

The laser printer also includes a charge roller 106 for uniformly charging a surface of the photosensitive drum 101, a developing device 107 for developing an electrostatic latent image formed on the photosensitive drum 101, using toner, a transfer roller 108 for transferring the toner image developed by the developing device 107 onto a predetermined recording sheet, and fixing rollers 109 for heating and thereby fusing the toner transferred on the recording sheet.

The laser printer is also provided with a cassette sheet feed roller 110 that feeds a sheet from a cassette having a function that recognizes the size of recording sheets and sends the sheet out to a conveyance path, by means of one revolution, a manual sheet feed roller 111 that sends a sheet onto the conveyance path from a manual sheet feed slot having no function that recognizes the size of recording sheets, an optional cassette sheet feed roller 112 that sends a sheet onto the conveyance path from a detachable cassette having a function that recognizes the size of recording sheets, envelope feeder sheet feed rollers 113 that send sheets one by one to the conveyance path from a detachable envelope feeder in which only envelopes can be loaded, and conveyance rollers 114 and 115 that convey a sheet fed from a cassette.

In the laser printer, a pre-feed sensor 116 for detecting a front end and a rear end of a sheet fed from a source other than the envelope feeder, pre-transfer rollers 117 that send a conveyed sheet to the photosensitive drum 101, a top sensor 118 for synchronizing the writing (recording/printing) of an image onto the photosensitive drum 101 and the sheet conveyance for a fed sheet, and also for measuring the length in the conveyance direction of the fed sheet, a sheet output sensor 119 for detecting whether or not there is a sheet after fixing, and output rollers 120 for outputting a sheet after fixing to the outside of the printer are arranged.

The laser printer includes a flapper 121 that switches the destination of conveyance of a printed sheet (between the outside of the printer and a detachable double-side printing unit), conveyance rollers 122 for conveying a sheet conveyed to the double-side printing unit to a reverse part, a reverse sensor 123 that detects a front end/back end of the sheet conveyed to the reverse part, reverse rollers 124 for sequentially performing normal/reverse rotations to reverse the sheet and conveying the sheet to a sheet re-feed part, a sheet re-feed sensor 125 for detecting whether or not there is a sheet in the sheet re-feed part, and sheet re-feed rollers 126 for sending the sheet in the sheet re-feed part again onto the conveyance path.

FIG. 12 illustrates a block diagram of a circuit configuration of a control system for controlling such mechanism part. In FIG. 12, a printer controller 201 converts image code data sent from an external apparatus such as a host computer (not illustrated) into bit data necessary for printing in the printer, and reads and displays printer internal information. A printer engine control part 202, which is connected to the printer controller 201, controls operations of respective parts in a printer engine according to instructions from the printer controller 201, and notifies the printer controller 201 of the printer internal information. The printer engine control part 202 is connected to a sheet conveyance control part 203, a high-voltage control part 204, an optical system control part 205 and a fixing device temperature control part 207. The sheet conveyance control part 203 drives/stops the motors and rollers, etc., for recording sheet conveyance according to instructions from the printer engine control part. The high-voltage control part 204 performs control of respective high voltage outputs in the respective processes of, e.g., charge, developing and transfer, according to instructions from the printer engine control part 202. The optical system control part 205 controls driving/stopping of the scanner motor 104 and turning-on of a laser beam according to instructions from the printer engine control part 202. The fixing device temperature control part 207 adjusts the temperature of the fixing device to a temperature designated by the printer engine control part 202. The printer engine control part 202 is configured to receive signals from the sensor input part 206.

The printer engine control part 202 is connected to an option cassette control part 208, a double-side printing unit control part 209 and an envelope feeder control part 210, which are detachable from the printer engine control part 202. The option cassette control part 208 drives/stops a drive system according to an instruction from the printer engine control part 202, and notifies the printer engine control part 202 of a status of whether or not there are sheets as well as sheet size information. The double-side printing unit control part 209 performs an operation to reverse and re-feed a sheet according to an instruction from the printer engine control part 202, and notifies the printer engine control part 202 of a status of the operation. The envelope feeder control part 210 drives/stops a drive system according to an instruction from the printer engine control part 202, and notifies the printer engine control part 202 of a status of whether or not there are sheets.

FIG. 13 illustrates a schematic configuration of a charge bias application circuit. The charge bias application circuit includes a charge DC bias application circuit part 401, a voltage setting circuit part 402 capable of changing a set value according to a PWM signal, a transformer drive circuit part 403, a high voltage transformer part 404 and a feedback circuit part 405. In the feedback circuit part 405, the value of a voltage applied to a charge element is detected by means of R71, and is transferred to the voltage setting circuit part as an analog value. Based on the value, control is performed so as to apply a constant voltage to the charge member. Such technique is indicated in, for example, Japanese Patent Application Laid-Open No. H06-003932.

The voltage at which a discharge starts between the charge member (C roller) and the photosensitive drum (hereinafter referred to as "drum"), which is an element to be charged, varies depending on, e.g., the circumstance conditions and/or the drum layer thickness. Accordingly, simple application of a fixed voltage results in variations in drum potential (see FIG. 14). Furthermore, the drum sensitivity also differs depending on the circumstances and/or the drum layer thickness (charge transport layer thickness), and accordingly, simple application of a fixed amount of laser light results in variations in drum surface potential (hereinafter referred to as "VL") after laser application (see FIG. 15). For example, as a method for correcting the variations, a memory is provided in a cartridge including a drum, e.g., bias values according to the sensitivities and/or usage of the photosensitive drum are stored in the memory, and based on such information, control is performed to provide a charge voltage, a developing voltage and a laser light amount according to the sensitivity and/or usage. However, with a further increase in print speed as well as an increase in capacity of the cartridge, the method of control based on the information in the memory in the cartridge has a limit in correcting variations of the voltage difference between Vdc and VL, which is illustrated in FIGS. 16A and 16B.

The present invention has been made in order to solve the aforementioned problem, and provides a high voltage control apparatus for forming a high-quality image by maintaining a potential on a photosensitive drum to be constant irrespective of the states of the circumstances and/or the drum layer thickness, and an image forming apparatus including the same.

SUMMARY OF THE INVENTION

The present invention provides a high-voltage output apparatus that outputs a high voltage to a charge member that charges an image bearing member, the high-voltage output apparatus including: a voltage application part that applies a DC voltage to the charge member; a current detection part that detects a value of a current flowing in the image bearing member when the DC voltage is applied to the charge member, and a control part that calculates a first discharge voltage for the image bearing member based on a current value detected by the current detection part as a result of the voltage application part applying a first DC voltages to the charge member and a second discharge voltage for the image bearing member based on a current value detected by the current detection part as a result of the voltage application part applying a second DC voltages to the charge member, and controls the DC voltage applied to the charge member, using the first discharge voltage and the second discharge voltage.

The present invention also provides an image forming apparatus including an image bearing member on which a latent image is formed, a charge member that charges the image bearing member; and a high-voltage output part that outputs a high voltage to the charge member, wherein the high-voltage output part includes a voltage application part that applies a DC voltage to the charge member, a current detection part that detects a value of a current flowing in the image bearing member when the DC voltage is applied to the charge member, and a control part that calculates a first discharge voltage for the image bearing member based on a current value detected by the current detection part as a result of the voltage application part applying a first DC voltages to the charge member and a second discharge voltage for the image bearing member based on a current value detected by the current detection part as a result of the voltage application part applying a second DC voltages to the charge member, and controls the DC voltage applied to the charge member, using the first discharge voltage and the second discharge voltage.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Hereinafter, a configuration and operation of the present invention will be described. Embodiments described below are mere examples and not intended to limit the technical scope of the present invention only to the embodiments.

Figure 1:
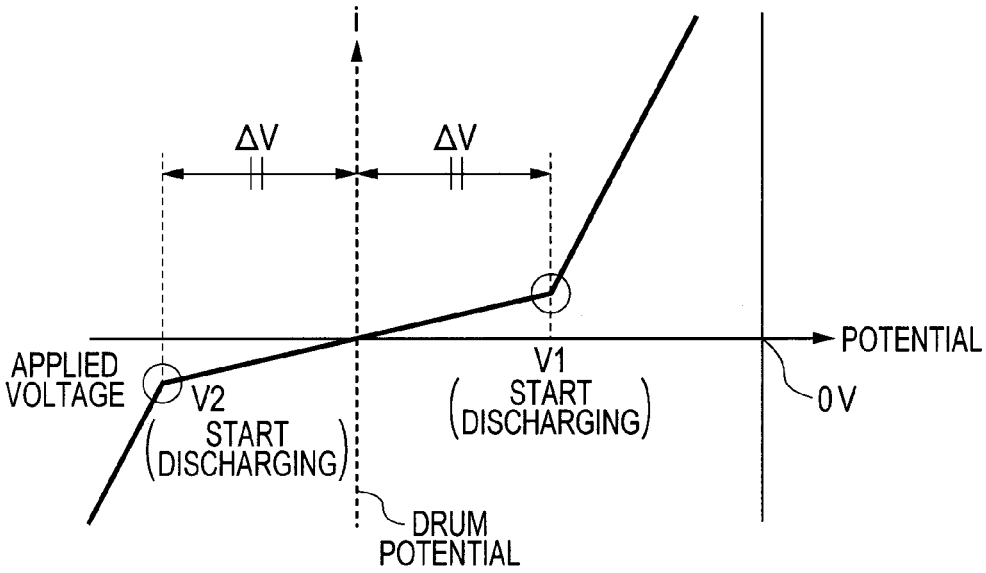
FIG. 1 illustrates a discharge characteristic of a photosensitive drum.

First, embodiment 1 will be described. A photosensitive drum (hereinafter also referred to as "drum"), which is an image bearing member in an image forming apparatus according to embodiment 1, has a discharge characteristic in that a potential difference necessary for a discharge differs depending on the difference in circumstances and/or layer thickness of the drum. However, as illustrated in FIG. 1, the drum also has a characteristic in that in the respective conditions of the drum (the circumstances and the layer thickness of the drum), a same potential difference relative to a drum potential is necessary for starting a discharge. This characteristic can be seen from the findings in the characteristics of a high voltage and is the same as a characteristic of a discharge in a gap (between planes).

Figure 2A:
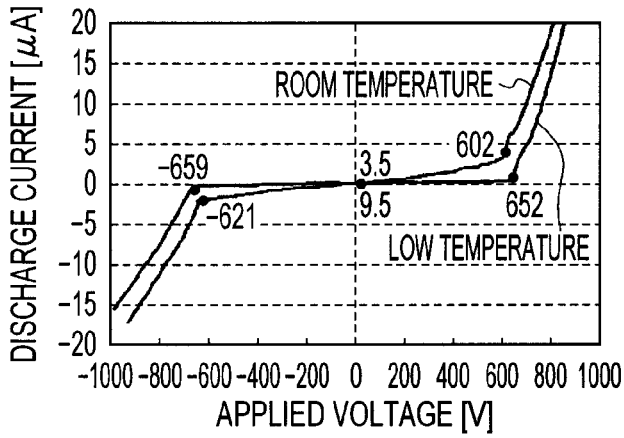
FIG. 2A illustrates results of measurements of a discharge characteristic of a photosensitive drum, which are results of drum characteristic measurements (different in circumstance).
Figure 2B:
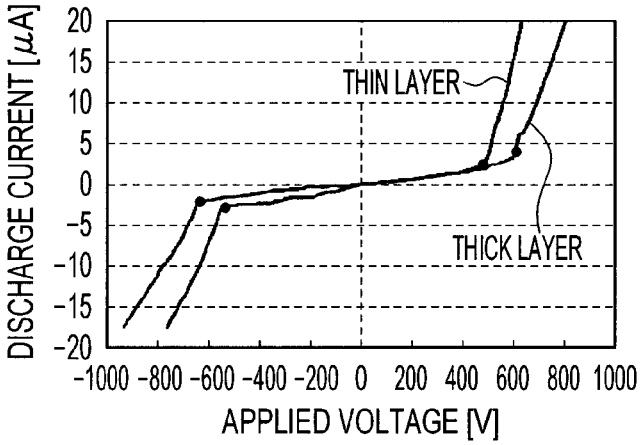
FIG. 2B illustrates results of measurements of a discharge characteristic of a photosensitive drum, which are results of drum characteristic measurements (different in layer thickness).
Figure 2C:
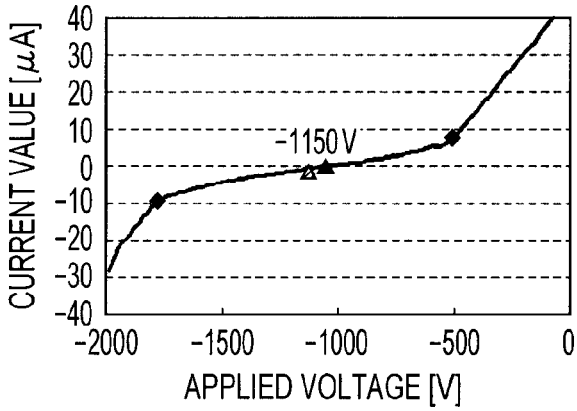
FIG. 2C illustrates results of a measurement of a discharge characteristic of a photosensitive drum, which is a result of a drum characteristic measurement (negative potential).

FIGS. 2A to 2C illustrate actual drum characteristic measurement results. FIG. 2A illustrates measurement results of characteristics in different circumstances, FIG. 2B illustrates measurement results of characteristics in different layer thicknesses. A symmetrical characteristic can be seen from the two characteristic data. The symmetrical characteristic has been obtained from results of application of positive and negative bias voltages relative to the drum potential. This symmetric characteristic does not vary even if the drum potential has a value other than 0V, for example, a negative value. FIG. 2C illustrates measurement data where the drum has a negative potential.

More specifically, FIG. 2A exhibits a symmetrical relationship between +602 V and −659 V with 3.5 V as its center at room temperature and a symmetrical relationship between +652 V and −621 V with 9.5 V as its center at a low temperature. Also, FIG. 2B illustrates a symmetrical relationship in each of the cases where the drum has a large layer thickness and where the drum has a small layer thickness. In FIG. 2C, a symmetrical relationship with −1150 V as its center can be seen.

In embodiment 1, focusing on this characteristic, a potential difference necessary for a discharge to a drum and a surface potential on the drum are detected, and based on the detection results, the light amount of a laser beam is variably set.

Figure 3:
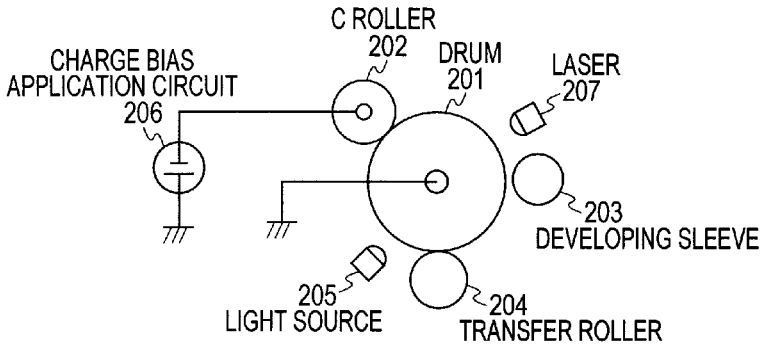
FIG. 3 schematically illustrates an image forming apparatus according to embodiment 1.

FIG. 3 is a schematic diagram of an image forming apparatus according to embodiment 1. The image forming apparatus includes a drum 201, a charge roller 202 (hereinafter referred to as "C roller" or "charge member"), a developing roller 203 (hereinafter also referred to as "developing sleeve"), a transfer roller 204, a charge bias application circuit 206, and a light source 205 that emits a laser beam. A series of control for image formation is started after charge (potential) remaining on the drum 201 is eliminated by an alternate voltage (hereinafter referred to as "AC bias") applied from the charge bias application circuit 206.

Figure 4:
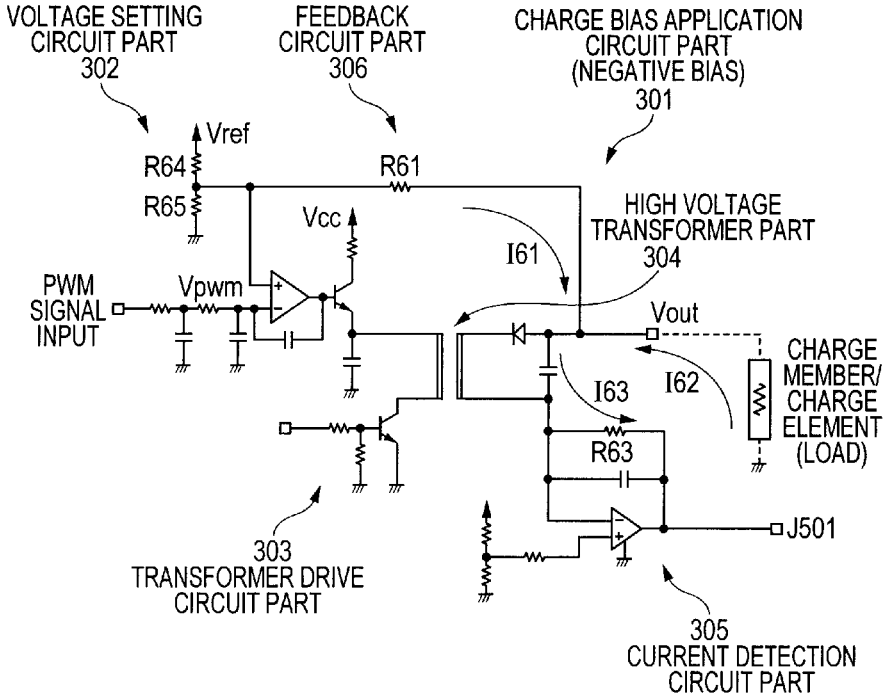
FIG. 4 schematically illustrates a charge bias application circuit part according to embodiment 1.

FIG. 4 illustrates a schematic configuration of a charge bias application circuit 301 (voltage application part) in embodiment 1. The charge bias application circuit 301 includes a voltage setting circuit part 302, which can change a bias value according to a PWM signal, a transformer drive circuit part 303 and a high voltage transformer part 304. In the charge bias application circuit 301, a feedback circuit part 306 and a current detection circuit part (current detection part) 305 are arranged. The feedback circuit part 306 monitors an output voltage via R61 and make adjustment to provide an output voltage value according to the setting of the PWM signal. The current detection circuit part (current detection part) 305 detects a value of a current I63, which is a sum of a value of a current I62 flowing in the charge element and a value of a current I61 flowing from the feedback circuit by means of R63, and transfers the value of the current I63 from J501 to a control part for an engine as an analog value.

Until a discharge starts between the drum and the C roller, the drum and the C roller are isolated. Accordingly, until start of a discharge, only the current I61, which flows from the feedback circuit part, flows in the detection resistance R63. The value of the current I61 is determined by Vpwm, which is set by the PWM signal, Vrefi, R64 and R65.

$$I61=(V\text{ref}-V\text{pwm})/R64-V\text{pwm}/R65$$

Also, an output voltage is also set as a result of the current I61 flowing in the feedback resistance R61.

$$V\text{out}=I61\times R61+V\text{pwm}\approx I61\times R61$$

Figure 5:
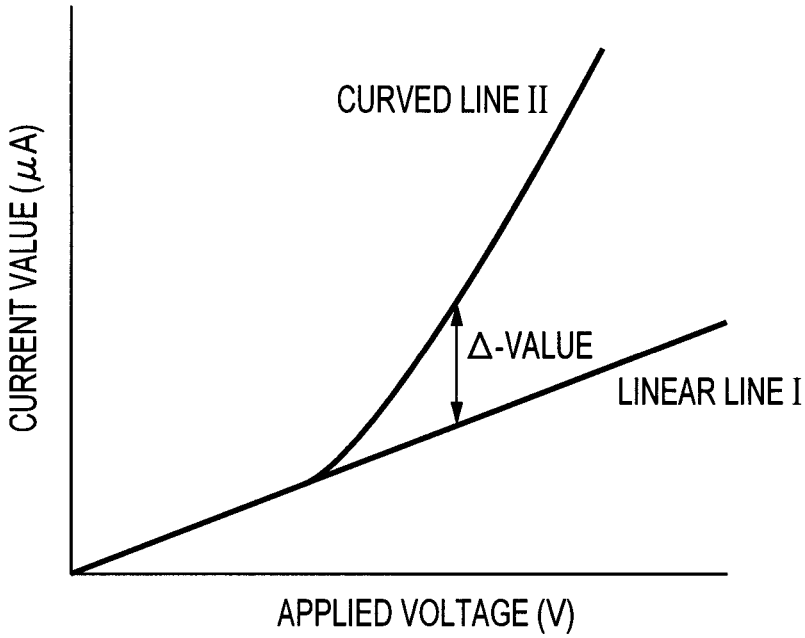
FIG. 5 schematically illustrates a V-I characteristic at the time of charge bias application in embodiment 1.

In other words, as illustrated in line I in FIG. 5, until start of a discharge, only the current I61 according to the PWM signal flows in R63 in the current detection circuit part, and thus, the relationship between the applied voltage and the discharge current exhibits a linear line.

However, upon start of a discharge between the drum and the C roller, the current I63 with a value that is a sum of the current value I62 flowing in the charge element and the value of the current I61 flowing from the feedback circuit, flows. In other words, as indicated in curved line II in FIG. 5, the line starts curving at the start of a discharge, diverting from linear line I.

Consequently, the current flowing in the drum, which is the element to be charged, can be calculated as a Δ value obtained by subtracting linear line I from curved line II. Among a plurality of Δ values obtained as described above, a point of time when a certain Δ value reaches a predetermined current value is determined to be a voltage at which a discharge started.

Such charge bias application circuit as described above is provided, and a bias voltage with a preset negative potential as its center is applied to the drum charged with the preset negative potential. Then, discharge start voltages (a detected voltage V1 with a lower-side absolute value and a detected voltage V2 with a higher-side absolute value) are detected, and a half of the difference between the voltage value V1 and the voltage value V2 is set to be a voltage difference ΔV necessary for starting a discharge to the drum (see FIG. 1).

Furthermore, after emission of a laser beam to the drum, which is the element to be charged, the voltage with a higher-side absolute value is applied using the charge bias application circuit, and a voltage value V3 for starting a discharge is obtained based on the current value at the time of the voltage application. Using the voltage value V3 for starting a discharge and the voltage value ΔV obtained as described above, the potential VL after laser beam emission can be calculated.

Then, control for correcting a light amount value of a laser beam emitted by the light source is performed according to the calculation value. Such control enables the difference between the drum potential and the developing bias (VL−Vdc) after laser emission to be constant even if variations occur in, e.g., the layer thickness of the drum and/or the circumstances.

Figure 6:
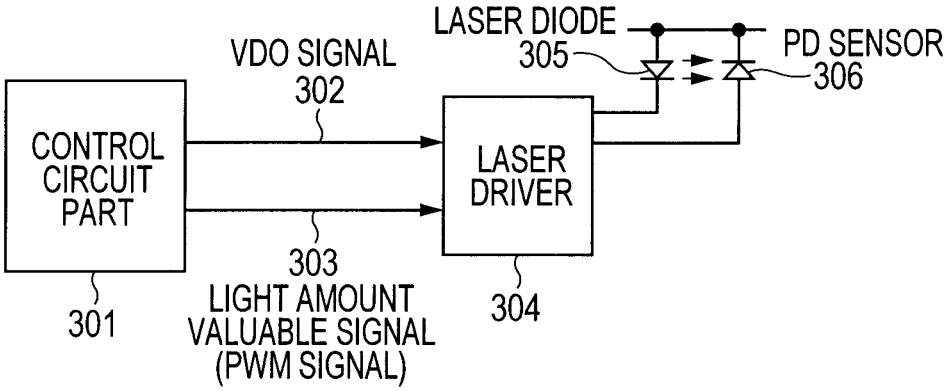
FIG. 6 illustrates a configuration of a laser drive circuit in embodiment 1.

FIG. 6 illustrates a schematic configuration of a laser drive circuit in embodiment 1. A laser driver 304 performs control so as to make a light amount of a laser beam emitted from a laser diode constant, while monitoring the light amount by means of a PD sensor 306. A light amount variable signal (PWM signal) 303 is connected between a control circuit part 301 and the laser driver 304, and the light amount can be changed according to the light amount variable signal (PWM signal) 303. In this configuration, the light amount of a laser beam emitted to the drum can be changed, and thus, after detection of the drum potential (VL) after laser beam emission, using the aforementioned high-voltage control, if the value is different from a predetermined value, the VL value (the potential on the drum) can be corrected by changing the light amount of the laser beam. Such correction enables maintenance of a constant difference between the drum potential and the developing bias (VL−Vdc) after laser beam emission.

Figures 7, 7A:
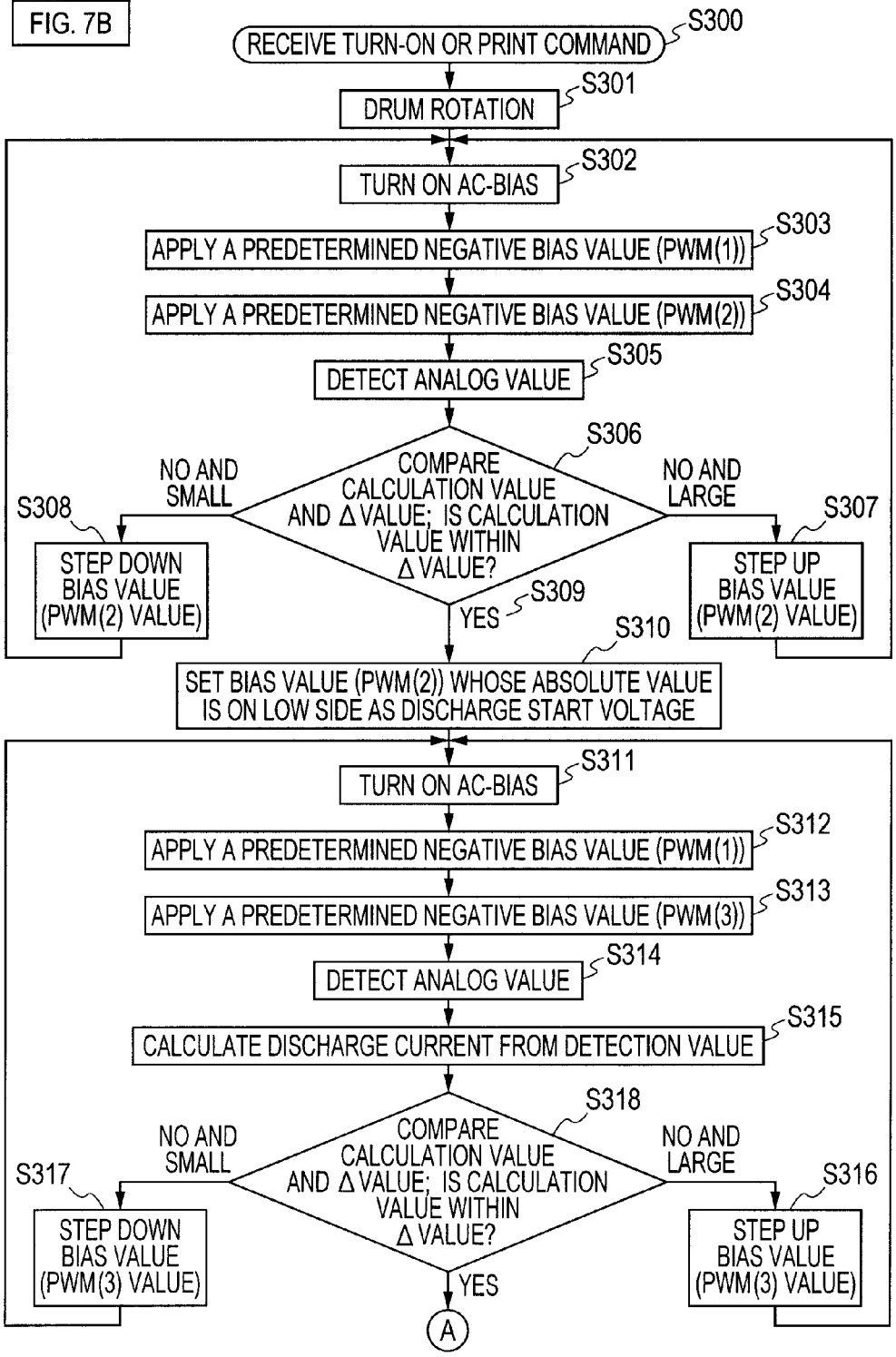
FIG. 7 which is comprised of FIGS. 7A and 7B are schematic flowcharts according to embodiment 1.
Figure 7B:
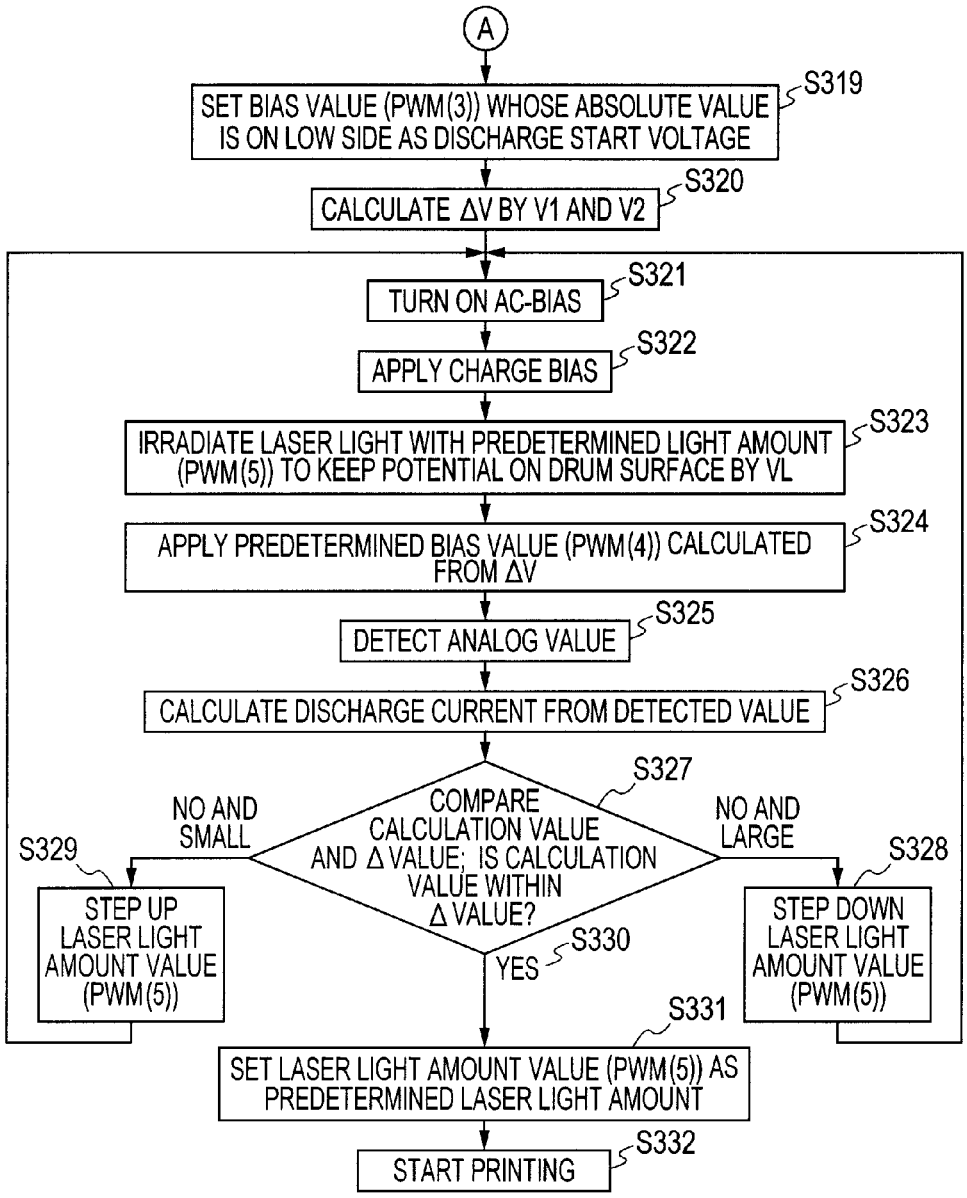
Figure 8A:
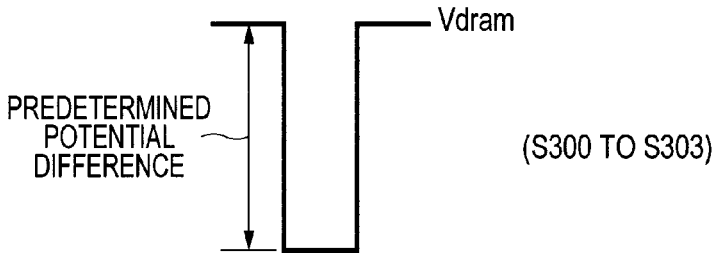
FIGS. 8A, 8B, 8C and FIG. 8D each illustrate a potential on a drum in embodiment 1.
Figure 8B:
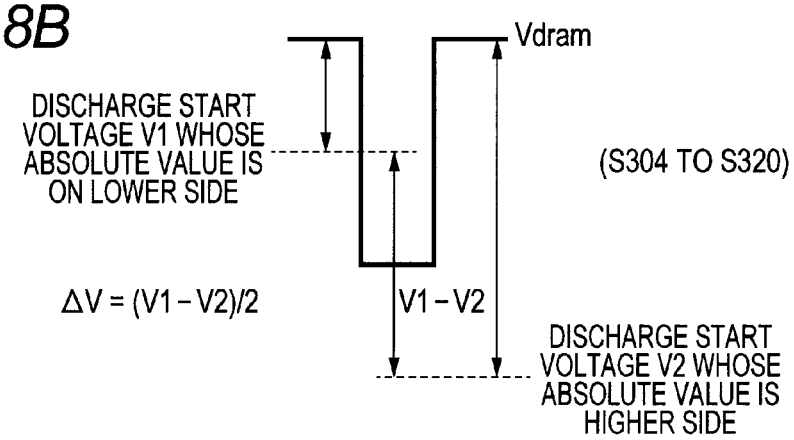
Figure 8C:
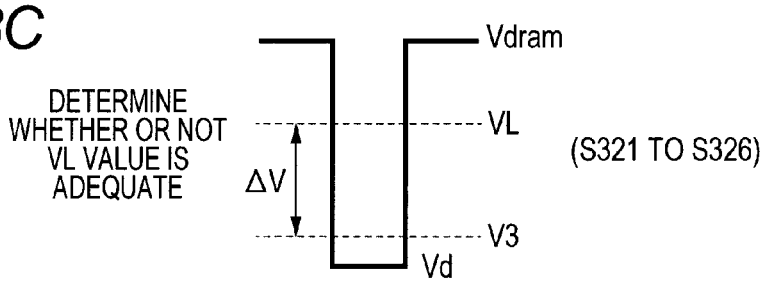
Figure 8D:
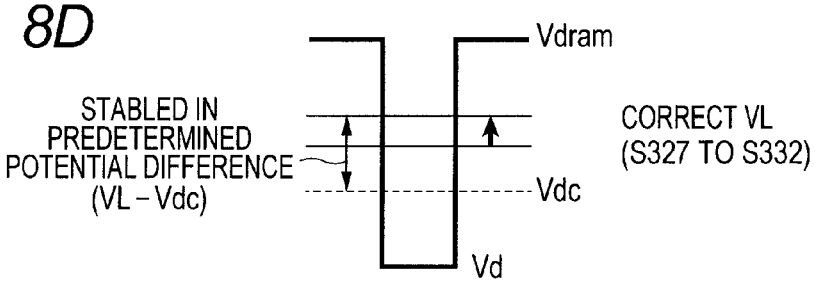

Next, the control in embodiment 1 will be described with reference to the flowcharts in FIGS. 7A and 7B and the potential diagrams in FIGS. 8A, 8B, 8C and 8D. In FIGS. 8A, 8B, 8C and 8D, Vdram is a zero potential on the drum and Vd is a back contrast potential.

First, after power-on or receipt of a print command (S300), an operation to rotate the drum a plurality of times is performed for an initial operation for equalizing the potential on the drum. This operation is called a multiple-pre-rotation process or a pre-rotation process. In a state in which the drum, which is the element is to be charged, is rotated by means of the multiple-pre-rotation process or the pre-rotation process (S301), an alternate voltage (hereinafter referred to as "AC bias") is applied to the C roller in a non-image region on the drum, thereby neutralizing the residual potential on the drum (S302). Subsequently, a predetermined negative bias (a set value of a PWM signal: PWM(1)) is applied to charge a surface of the drum with a negative potential (S303).

In such state, using the charge bias application circuit, a charge bias (DC bias) with the potential of the drum, which has been charged with the predetermined negative potential, as its center is applied to the drum. First, the absolute value of the voltage is gradually decreased (S304). The current I63 with a current value that is a sum of the current values of the current I62 flowing from the drum and the current I61 flowing from the feedback circuit is detected as an analog value from the output terminal J501 (S305). From the detection value, a discharge current is calculated according to the aforementioned theory. Then, the calculation value of the discharge current and the Δ value are compared to determine whether or not the calculation value is within a tolerance (error margin) of the Δ value (S306). The Δ value is a value for determining whether or not the detected value is within a predetermined error margin. If the difference between the calculated discharge current value and the Δ value is large, it is determined that the discharge start voltage is set to be lower, and the bias value (the set value of the PWM signal) is increased (S307). Meanwhile, if the difference is small, it is determined that the discharge start voltage is set to be higher, the bias value (the set value of the PWM signal) is decreased (S308). When the calculation value falls within the tolerance of the Δ value as a result of this operation (S309), the bias value (the set value of the PWM signal: PWM(2)) at the time is set as a discharge start voltage V1 with a lower-side absolute value (S310).

Next, an AC bias is applied again to eliminate charges on the drum (S311), the drum is charged with a predetermined negative potential using the charge bias application circuit (S312), and then a charge bias (DC bias) with the potential as its center is applied. Then, this time, the absolute value is gradually increased (S313). In such state, the current I63 with a value that is a sum of the current values of the current I62 flowing from the drum and the current I61 flowing from the feedback circuit is detected from an analog value output from J501 (S314). From the detection value, a discharge current is calculated according to the aforementioned theory (S315). Then, the calculated discharge current value and the Δ value are compared to determine whether or not the calculated value is within a tolerance of the Δ value. If the difference between the calculated discharge current value and the Δ value is large, it is determined that the discharge start voltage have been set to be lower, and the bias value (the set value of the PWM signal) is increased (S316). If the difference is small, it is determined that the discharge start voltage has been set to be higher, the bias value (the set value of the PWM signal) is decreased (S317). When the calculation value falls within the tolerance of the Δ value (S318) as a result of this operation, the bias value (the set value of the PWM signal: PWM(3)) at the time is set as a discharge start voltage V2 with a higher-side absolute value (S319).

A half of the difference between V1 and V2, which have been set as described above, is calculated, and the calculated voltage difference ΔV is set as a voltage difference necessary for stating a discharge to the drum (S320).

Next, the process proceeds to a sequence for detecting the potential VL after laser emission. First, the residual potential is neutralized by an AC bias (S321). Subsequently, a charge bias (DC bias) is applied to the drum (S322), and a laser is emitted to the drum to make the drum have a potential VL after laser emission (S323). Next, a DC negative bias (PWM (4)) with a predetermined DC voltage, which has been calculated based on ΔV, is applied (S324). The applied voltage is a voltage V3 with a value obtained by adding ΔV to VL. Then, in such state, the current I63, which is a sum of the current I62 from the photosensitive drum and the current I61 from the feedback circuit is detected from an analog value from J501 (S325). From the detection value, a discharge current is calculated according to the aforementioned theory (S326). Then, the calculation value and the Δ value are compared to determine whether or not the calculation value is within the tolerance of the Δ value (S327). If the difference between the calculation value and the Δ value is large, it is determined that the VL value is set to be lower, and the laser light amount setting value (a set value of a PWM signal: PWM(5)) is decreased, thereby decreasing the light amount (S328). Meanwhile, If the difference is small, it is determined that the VL value has been set to be higher, the laser light amount setting value (the set value of the PWM signal: PWM(5)) is increased, thereby increasing the light amount (S329). When the calculation value falls within the tolerance of the Δ value (S330) as a result of this operation, the laser light amount setting value (the set value of the PWM signal: PWM(5)) at the time is determined and thus set as a predetermined laser light amount (S331). As a result of the sequence being performed, the voltage difference between VL and Vdc is controlled so as to have a predetermined value. After completion of these settings, printing is started (S332).

As a result of the above-described control being performed, a constant drum potential irrespective of the circumstances and/or drum layer thickness can be obtained, enabling provision of a high-quality image.

Next, embodiment 2 will be described. As in embodiment 1, embodiment 2 also uses the characteristic of the potential difference relative to the drum potential necessary for starting a discharge being the same. In embodiment 2, focusing on this characteristic, a potential difference necessary for a discharge to a drum and a surface potential on the drum are detected and based on the detection results, setting of a developing bias is corrected. Embodiment 2 is different from embodiment 1 in that embodiment 2 includes no function that can change a laser light amount. Since there is no need to include function that can change a laser light amount, embodiment 2 has a configuration that is more inexpensive than that of embodiment 1.

A schematic configuration of an image forming apparatus and a schematic configuration of a charge bias application circuit in embodiment 2 are similar to those in embodiment 1, and thus, a description thereof will be omitted.

Figures 9, 9A:
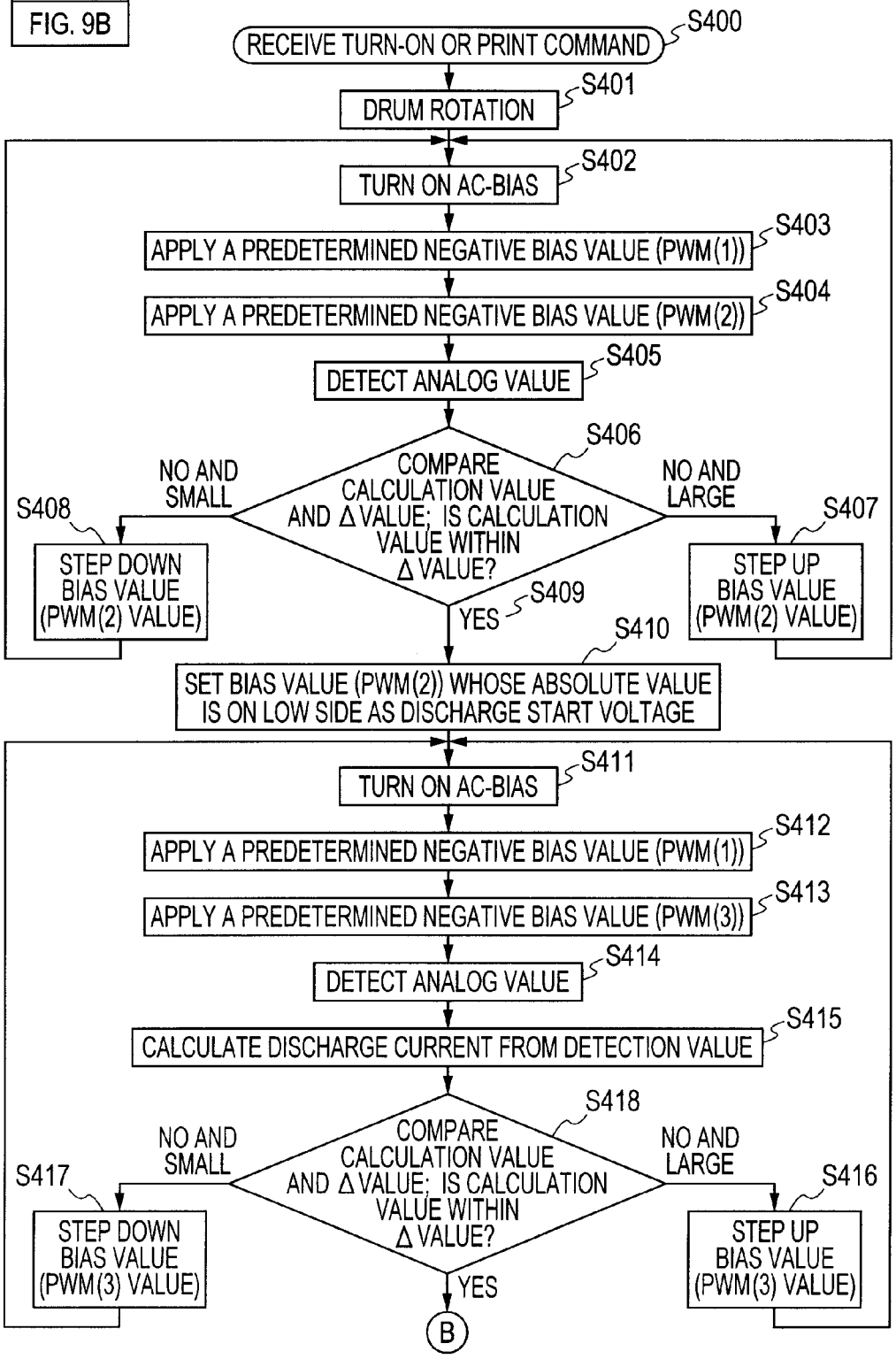
FIG. 9 which is comprised of FIGS. 9A and 9B illustrates schematic flowcharts according to embodiment 2.
Figure 9B:
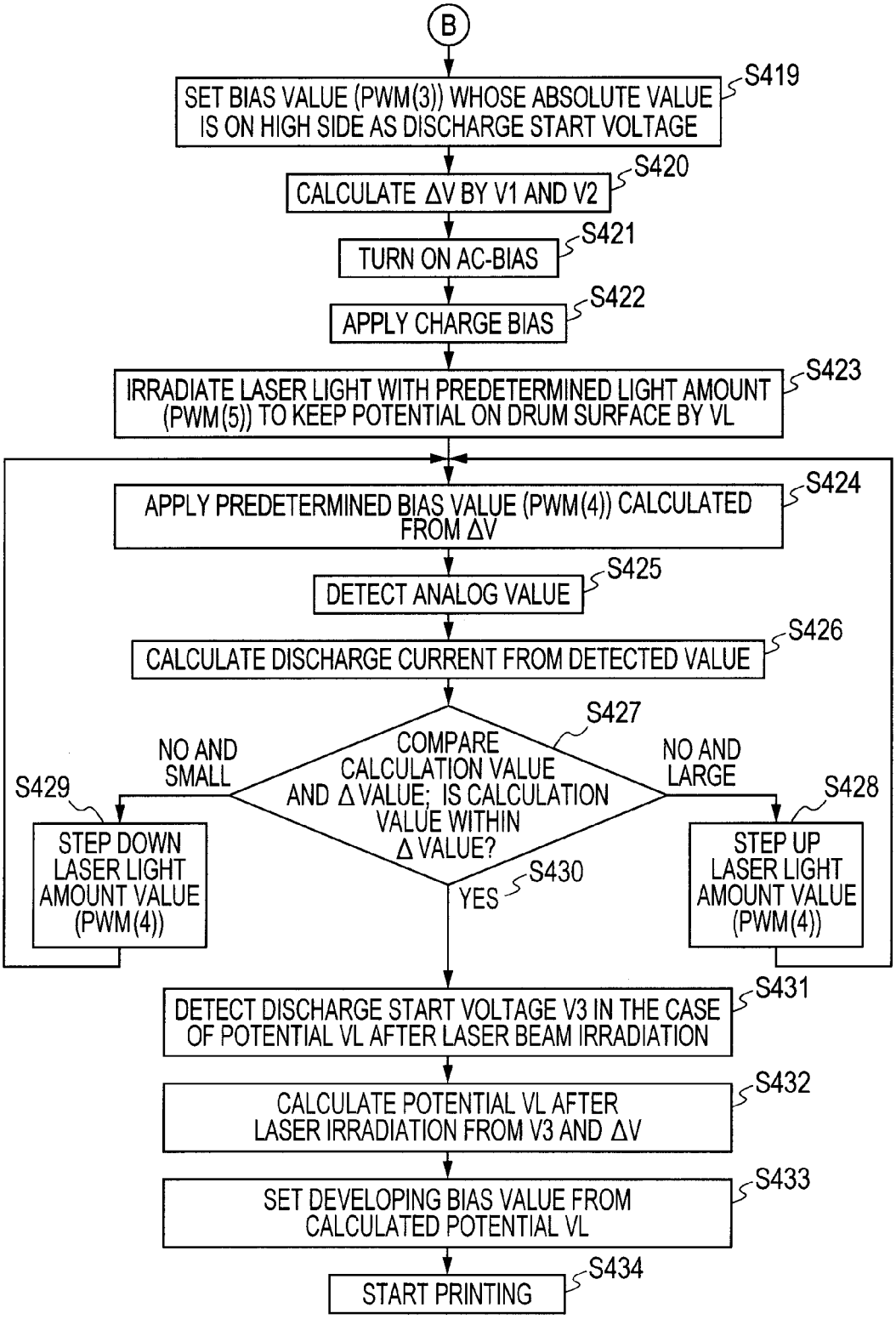
Figure 10A:
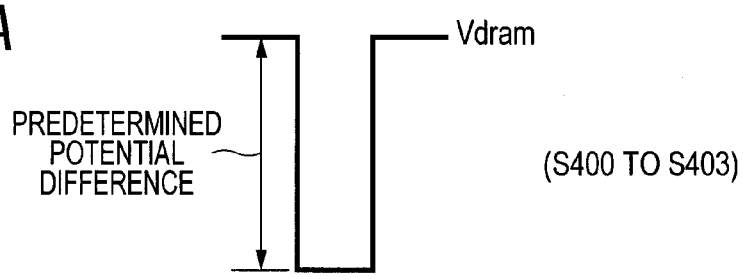
FIGS. 10A, 10B, 10C and 10D each illustrate a potential on a photosensitive drum in embodiment 2.
Figure 10B:
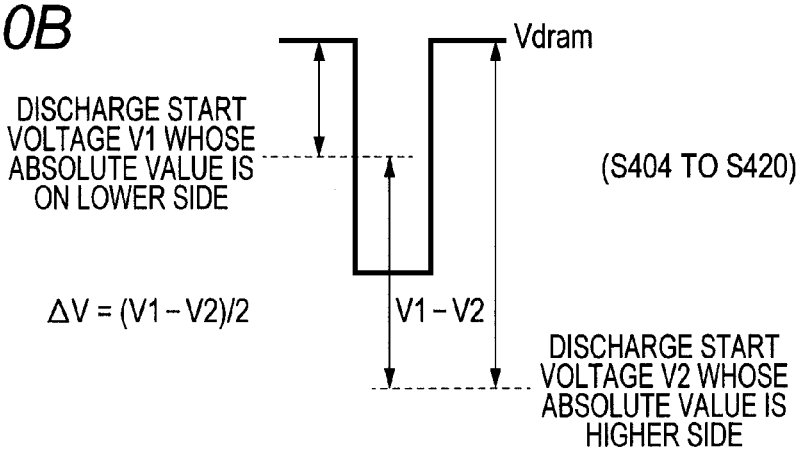
Figure 10C:
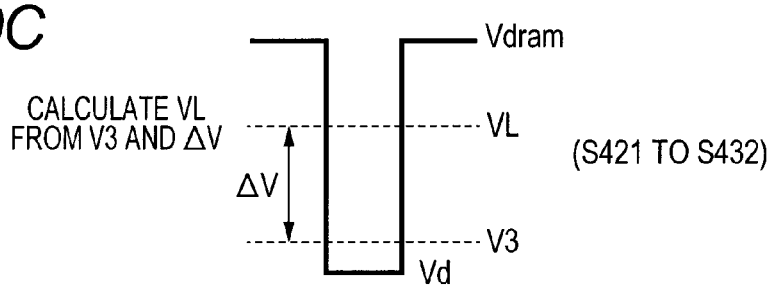
Figure 10D:
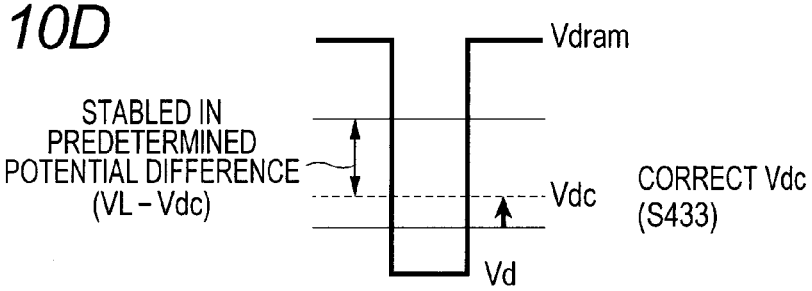
Figure 11:
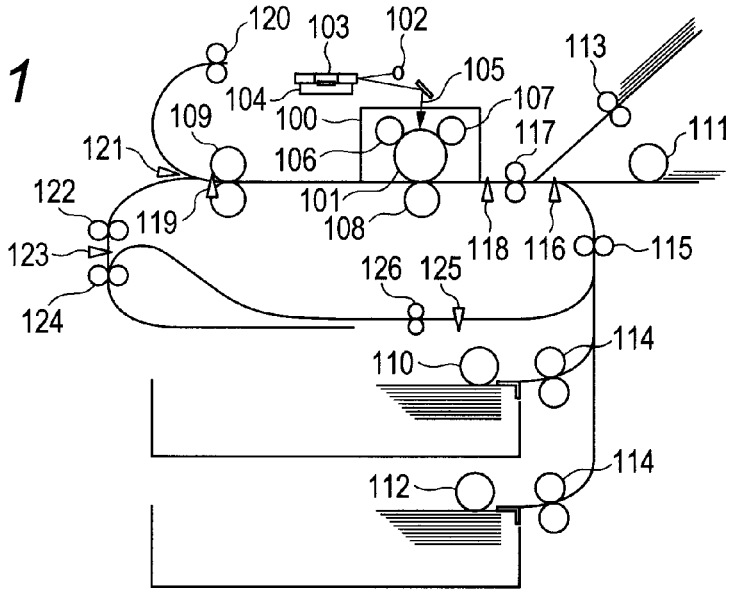
FIG. 11 schematically illustrates a configuration of a body of an image forming apparatus.
Figure 12:
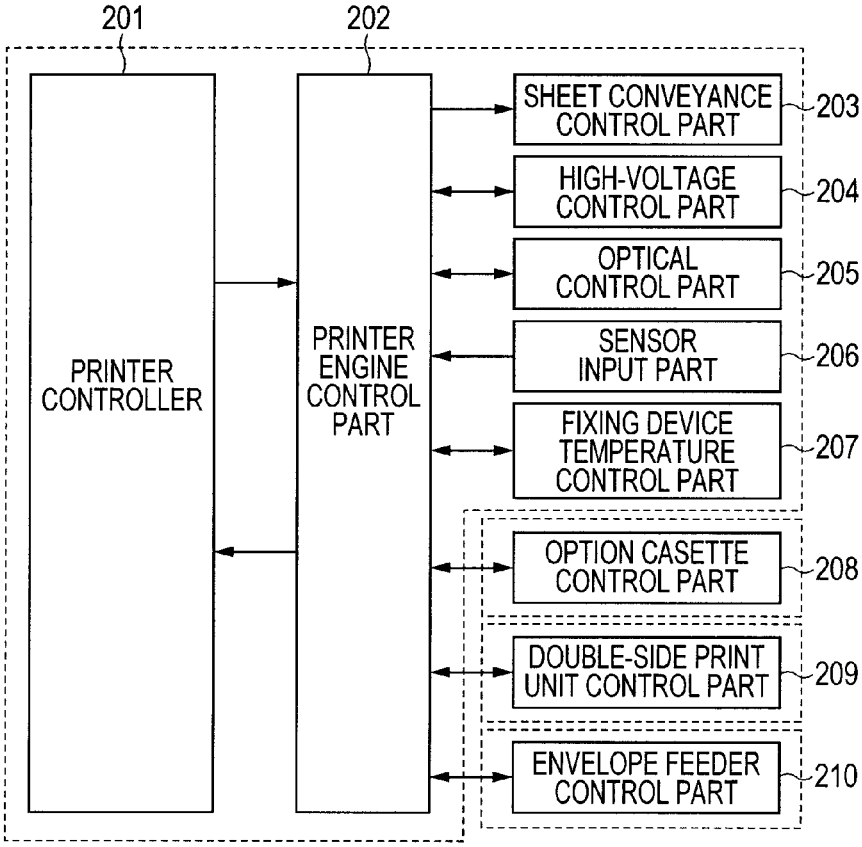
FIG. 12 schematically illustrates a controller part in an image forming apparatus.
Figure 13:
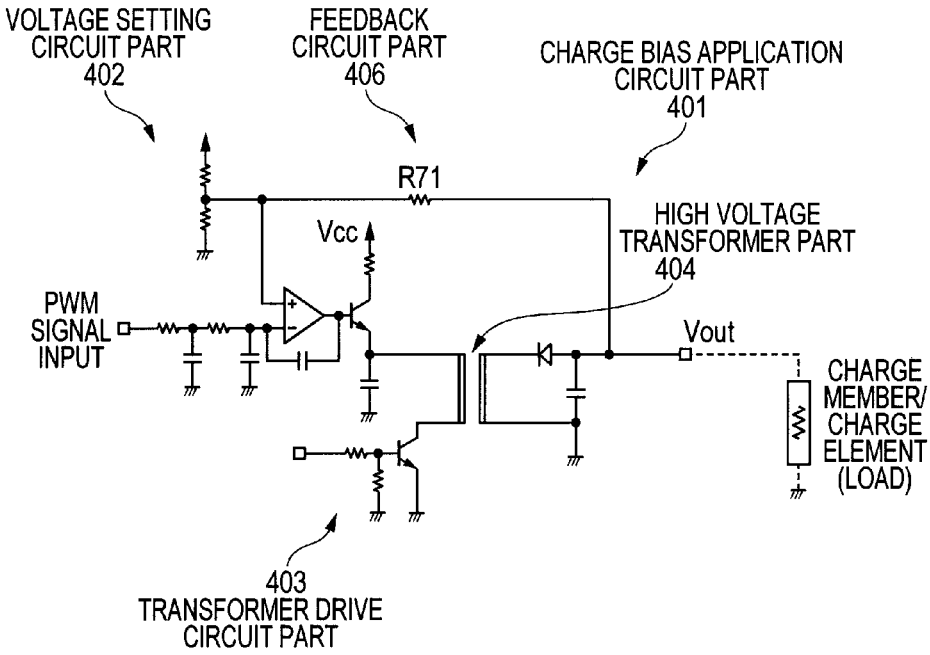
FIG. 13 illustrates a conventional charge bias application circuit.
Figure 14:
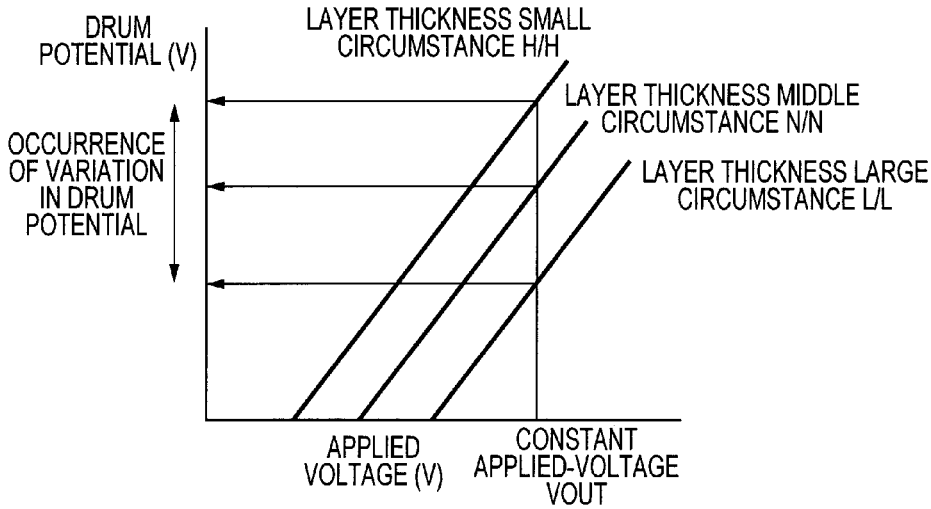
FIG. 14 illustrates variations occurring in a drum potential Vd.
Figure 15:
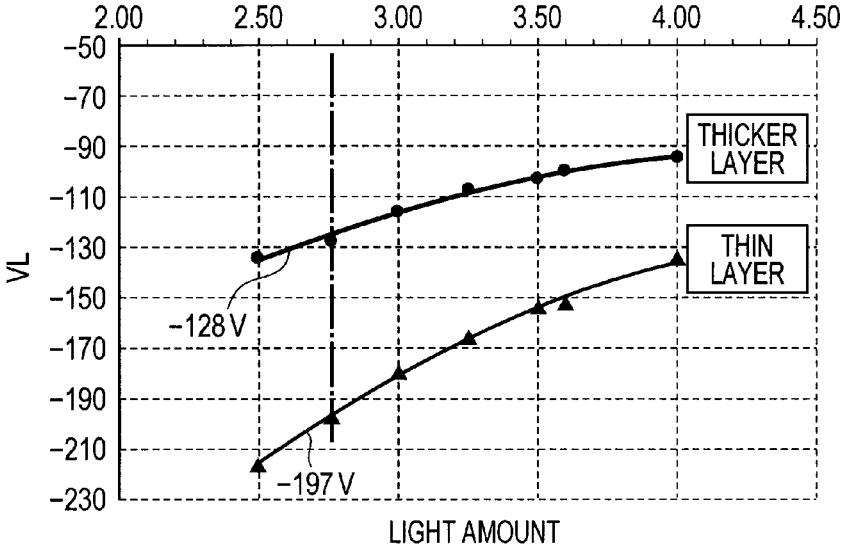
FIG. 15 illustrates variations occurring in a drum potential VL after laser emission.
Figure 16A:
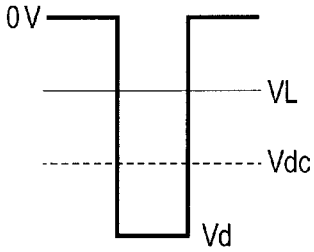
FIGS. 16A and 16B each illustrate a relationship between potentials on a drum.
Figure 16B:
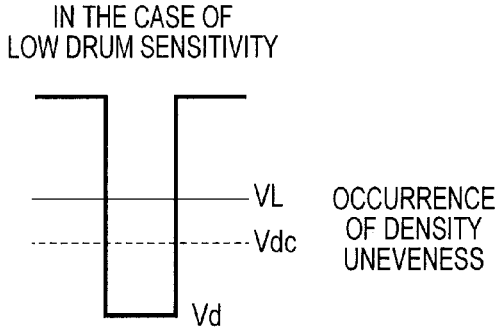

Next, control in embodiment 2 will be described with reference to the flowcharts in FIGS. 9A and 9B and the potential diagrams in FIGS. 10A, 10B, 10C and 10D.

First, after power-on or receipt of a print command (S400), in a non-image region on the photosensitive drum, an element to be charged, which is being rotated by means of an operation, e.g., a multiple-pre-rotation process or a pre-rotation process (S401), a residual potential on the drum is neutralized by means of an AC bias (S402). Subsequently, a predetermined negative bias (a set value of a PWM signal: PWM(1)) is applied to charge a surface of the drum with a negative potential (S403).

In such state, using a charge bias application circuit, a bias (DC bias) with the potential of the drum, which has been charged with the predetermined negative potential, as its center is applied to the drum. First, the absolute value of the voltage is gradually decreased (S404). The current I63 with a current value that is a sum of the current values of the current I62 flowing from the photosensitive drum and the current I61 flowing from the feedback circuit is detected from an analog value output from J501 (S404). From the detection value, a discharge current is calculated according to the aforementioned theory. Then, the calculation value and a Δ value are compared to determine whether or not the calculation value is within a tolerance of the Δ value (S406). If the difference between the calculation value and the Δ value is large, it is determined that the discharge start voltage has been set to be lower, the bias value (PWM value) is increased (S407). Meanwhile, if the difference is small, it is determined that the discharge start voltage has been set to be higher, the bias value (PWM value) is decreased (S408). When the calculation value falls within the tolerance of the Δ value as a result of this operation (S409), the bias value (the set value of the PWM signal: PWM(2)) at the time is set as a discharge start voltage V1 with a lower-side absolute value (S410).

Next, the photosensitive drum is neutralized again by means of an AC bias (S411), the drum is charged with a predetermined negative potential using the charge bias application circuit (S412), and then a bias (DC bias) is applied. This time, the absolute value is gradually increased (S413). In such state, the current I63 with a value that is a sum of the current values of the current I62 flowing from the photosensitive drum and the current I61 flowing from the feedback circuit is detected from an analog value output from J501 (S414). From the detection value, a discharge current is calculated according to the aforementioned theory (S415). Then, the calculation value and the Δ value are compared to determine whether or not the calculation value is within a tolerance of the Δ value. If the difference between the calculation value and the Δ value is large, it is determined that the discharge start voltage has been set to be lower, the bias value (PWM signal value) is increased (S416). Meanwhile, the difference is small, it is determined that the discharge start voltage has been set to be higher, the bias value (PWM signal value) is decreased (S417). When the calculation value falls within the tolerance of the Δ value as a result of this operation (S418), the bias value (PWM(3)) at the time is set as a discharge start voltage V2 with a higher-side absolute value (S419).

Subsequently, a half of the difference between V1 and V2 is calculated as a voltage difference ΔV necessary for starting a discharge to the drum (S420). Next, the process proceeds to a sequence for detecting a potential VL after laser emission. First, a residual potential is neutralized by an AC bias (S421). Subsequently, a charge bias is applied to the drum (S422), and a laser is emitted to make the drum have a potential VL after laser emission (S423). Next, a predetermined DC negative bias (PWM(4)) is applied (S424), and in such state, the current I63 with a value that is a sum of the current values of the current I62 from the photosensitive drum and the current I61 from the feedback circuit is detected from an analog value output from J501 (S425). From the detection value, a discharge current is calculated according to the aforementioned theory (S426), and the calculation value and the Δ value are compared to determine whether or not the calculation value is within the tolerance of the Δ value (S427). If the difference between the calculation value and the Δ value is large, it is determined that a discharge start voltage has been set to be lower, and the bias value (PWM signal value) is increased (S428). Meanwhile, if the difference is small, it is determined that the discharge start voltage has been set to be higher, the bias value (PWM signal value) is decreased (S429). When the calculation value falls within the tolerance of the Δ value as a result of this operation (S430), the bias value (PWM(4)) at the time is set as a discharge start voltage V3 for a potential VL after laser emission (S431).

The potential VL after laser emission is calculated from the difference between the voltage difference ΔV necessary for starting a discharge to the drum, which has been obtained as described above and the discharge start voltage V3 for the potential VL after laser emission (S432).

$$VL = V3 - \Delta V \text{ (absolute value)}$$

Then, the developing bias value is corrected according to the calculated value of the potential VL (S433). As a result of the above-described sequence being performed, the voltage difference between VL and Vdc is controlled so as to have a predetermined value. After completion of these settings, printing is started (S434).

As a result of the above-described control being performed, a constant drum potential irrespective of the circumstances and/or drum layer thickness can be obtained, enabling provision of a high-quality image.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-048991, filed Mar. 5, 2010, which is hereby incorporated by reference herein in its entirety.

What is claimed is:

1. A high-voltage output apparatus that outputs a high voltage to a charge member that charges an image bearing member, comprising:

a voltage application part that applies a DC voltage to the charge member with a predetermined potential;

a current detection part that detects a value of a current flowing in the charge member when the DC voltage is applied to the charge member;

an exposure unit which exposes the image bearing member to form an electrostatic latent image on the image bearing member; and a control unit that obtains information of voltage differences between a first DC voltage and a second DC voltage, the first DC voltage being a voltage when a detected current detected by the current detection part reaches a current value that indicates a start of discharge between the image bearing member and the charge member under a condition where the voltage application part applies the DC voltage to the charge member so that the DC voltage is varied on a higher-potential side with regard to the predetermined potential, and the second DC voltage being a voltage when the detected current detected by the current detection part reaches a current value that indicates a start of discharge between the image bearing member and the charge member under a condition where the voltage application part applies the DC voltage to the charge member so that the DC voltage is varied on a lower-potential side with regard to the predetermined potential, wherein the control unit obtains a potential on the image bearing member after the exposure unit exposes the image bearing member based on the information of the voltage differences between the first DC voltage and the second DC voltage.

2. The high-voltage output apparatus according to claim 1, wherein the control part calculates a half of a difference between the first DC voltage and the second DC voltage as a voltage difference, and wherein the control unit controls a light amount from the exposure unit so that the current detected by the current detection part is to be at a predetermined value by applying a voltage to the charge member according to the voltage differences after the exposure unit exposes the image bearing member.

3. The image forming apparatus according to claim 2, the exposure unit includes a laser light emission unit that emits laser light to the image bearing member and the control unit controls an amount of the laser light.

4. The image forming apparatus according to claim 3, further comprising a developing member that develops the latent image formed on the image bearing member, wherein the control unit controls the exposure unit so that a potential difference between a potential according to a development voltage by the developing member and a potential on the image bearing member after the exposure unit exposes the image bearing member is to be a predetermined value.

* * * * *